US005080568A

United States Patent [19]

Zimmern

[11] Patent Number: 5,080,568

[45] Date of Patent: Jan. 14, 1992

[54] POSITIVE DISPLACEMENT ROTARY MACHINE

[76] Inventor: Bernard Zimmern, 6 New St., East Norwalk, Conn. 06855

[21] Appl. No.: 631,931

[22] Filed: Sep. 20, 1990

[51] Int. Cl.[5] ..... F04C 18/50

[52] U.S. Cl. ..... 418/195; 403/374; 418/196

[58] Field of Search ..... 418/195, 196; 403/374, 403/378, 379

[56] References Cited

U.S. PATENT DOCUMENTS

| | | | |
|---|---|---|---|
| 939,933 | 11/1909 | Trautner | 403/378 |
| 3,106,912 | 10/1963 | Kahlert | 418/195 |
| 3,180,565 | 4/1965 | Zimmern . | |
| 3,788,784 | 1/1974 | Zimmern | 418/195 X |
| 4,036,567 | 7/1977 | Sato | 418/195 X |
| 4,074,957 | 2/1978 | Clarke et al. | 418/195 |
| 4,610,612 | 9/1986 | Kocher | 418/195 |
| 4,768,750 | 9/1988 | Wilson | 403/379 |

FOREIGN PATENT DOCUMENTS

| | | | |
|---|---|---|---|
| 2237297 | 7/1973 | Fed. Rep. of Germany . | |
| 2833292 | 2/1979 | Fed. Rep. of Germany | 418/195 |
| 1331998 | 5/1962 | France . | |
| 2267462 | 11/1975 | France . | |
| 2624215 | 6/1989 | France . | |

*Primary Examiner*—Richard A. Bertsch
*Assistant Examiner*—David L. Cavanaugh
*Attorney, Agent, or Firm*—Finnegan, Henderson, Farabow, Garrett & Dunner

[57] ABSTRACT

The positive displacement rotary machine to compress or expand a fluid between a high and a low pressure comprises a screw provided with at least one groove, rotatably mounted in a casing and meshingly cooperating with at least one gaterotor carrying teeth which protrude into the groove to define with the casing a volume for variation of pressure of the fluid. One side of the teeth is being exposed to the high pressure fluid. The high pressure side of the teeth is in sealing proximity with a lip of the casing. The center of the gaterotor is hollow and carries bearings supporting the gaterotor for rotation around a fixed shaft extending through the rotor. Said shaft is secured to the casing in a portion thereof facing the high pressure side of the teeth by a key which has an axis substantially perpendicular to the shaft axis and is pressed against a flat portion provided on the shaft.

4 Claims, 2 Drawing Sheets

POSITIVE DISPLACEMENT ROTARY MACHINE

TECHNICAL FIELD

This invention relates to a positive displacement rotary machine of the screw and gaterotor type.

BACKGROUND OF THE INVENTION

It is known for instance from U.S. Pat. No. 3,180,565 to build positive displacement machines comprising a screw with grooves rotating in a bore of a casing and cooperating with at least one gaterotor having teeth meshingly protruding in said grooves to define with the casing variable volume chambers.

The teeth, when in mesh with the screw, protrude into the bore through a slot of the casing and are subjected to pressure on one face of said teeth while said face is maintained in sealing engagement with a lip defined by the casing along the slot adjacent the bore.

In known constructions, the gaterotor has a shaft rotating inside bearings located in the casing; or alternatively the gaterotor has a hollow core and rotates around a fixed shaft. In both embodiments, the axial location of the gaterotor and hence the positioning of the high pressure face of the teeth with respect to the lip is achieved by securing to the casing the low pressure side of the gaterotor shaft.

The reason to do so is that there is plenty of room available on this side of the gaterotor whereas the other side does not allow much space, particularly in compressors equipped with slides according for instance to U.S. Pat. No. 4,074,957.

As a result the axial location of the gaterotor is made by securing the bearing locating the gaterotor shaft to a portion of the casing which is separated from the lip by the slot of the casing.

Thus, in operation, due to pressure or temperature changes, the portion of the casing in which the gaterotor location is anchored can undergo substantial displacements with respect to the lip, thereby either creating a clearance between said lip and the gaterotor teeth and leakages, or creating interference between the gaterotor and the lip, such interference being liable to result in wear and possible destruction of the gaterotor.

SUMMARY OF THE INVENTION

This invention relates to a positive displacement rotary machine to compress or expand a fluid between a high and a low pressure comprising a screw provided with at least one groove, rotatably mounted in a casing and cooperating with at least one gaterotor carrying teeth which meshingly protrude into the groove to define with the casing a volume for variation of pressure of the fluid, one side of the teeth being exposed to the high pressure fluid whereas the other side is exposed to the low pressure fluid, the high pressure side of the teeth being in sealing proximity of a lip of the casing, wherein the center of the gaterotor is hollow and caries bearings supporting to gaterotor for rotation around a fixed shaft extending through the gaterotor and wherein said shaft is secured to the casing in a portion thereof facing the high pressure side of the teeth by attachment means. In a preferred embodiment said attachment means comprises a key, the axis of which is substantially perpendicular to the shaft axis and is pressed against a flat portion provided on said fixed shaft.

By this construction, the change of distance between the point where the gaterotor shaft is anchored in the casing and the lip has been eliminated and it is achieved by a system which takes very little space. Moreover, this assembly simultaneously provides interesting new technical effects.

First, because the locking mechanism is roughly perpendicular to the gaterotor shaft, the operation of locking the shaft does not move axially the shaft; thus, an axial position can be precisely obtained, whereas other mechanisms such as screws and nuts locating the gaterotor shaft axially, result in a little axial motion at the time they are tightened.

It is for instance possible with this assembly to press slightly the gaterotor against the lip and lock it in that position, knowing that it won't be pressed more against the lip by the action of locking the key.

The invention moreover provides a second and interesting result. After having mounted tight against the the lip a gaterotor according to the invention, it has been found after many hours of running that the high pressure face of the gaterotor did not touch the casing lip.

It seems that the axial load created on the gaterotor by the pressure was enough to slightly increase the length of the shaft and compress the balls of the ball bearing, and consequently to create between the gaterotor high pressure face and the lip a gap of 20 to 30 microns.

Experiments have shown that in a compressor used for air conditioning with refrigerant called "R22" and a screw diameter equal to 140 millimeters, the clearance during operation could be reduced from 60–80 microns in a conventional assembly with anchoring of the gaterotor in the casing on the low pressure side of the gaterotor to 20–30 microns in a machine according to the invention, thereby producing a significant improvement in efficiency while at the same time simplifying the construction and easing the assembly of the gaterotor into the compressor.

BRIEF DESCRIPTION OF THE DRAWINGS

This invention will be better understood by reading the following description given as a non-limiting example by reference to the accompanying drawings in which.

PREFERRED EMBODIMENT

Figure 1:
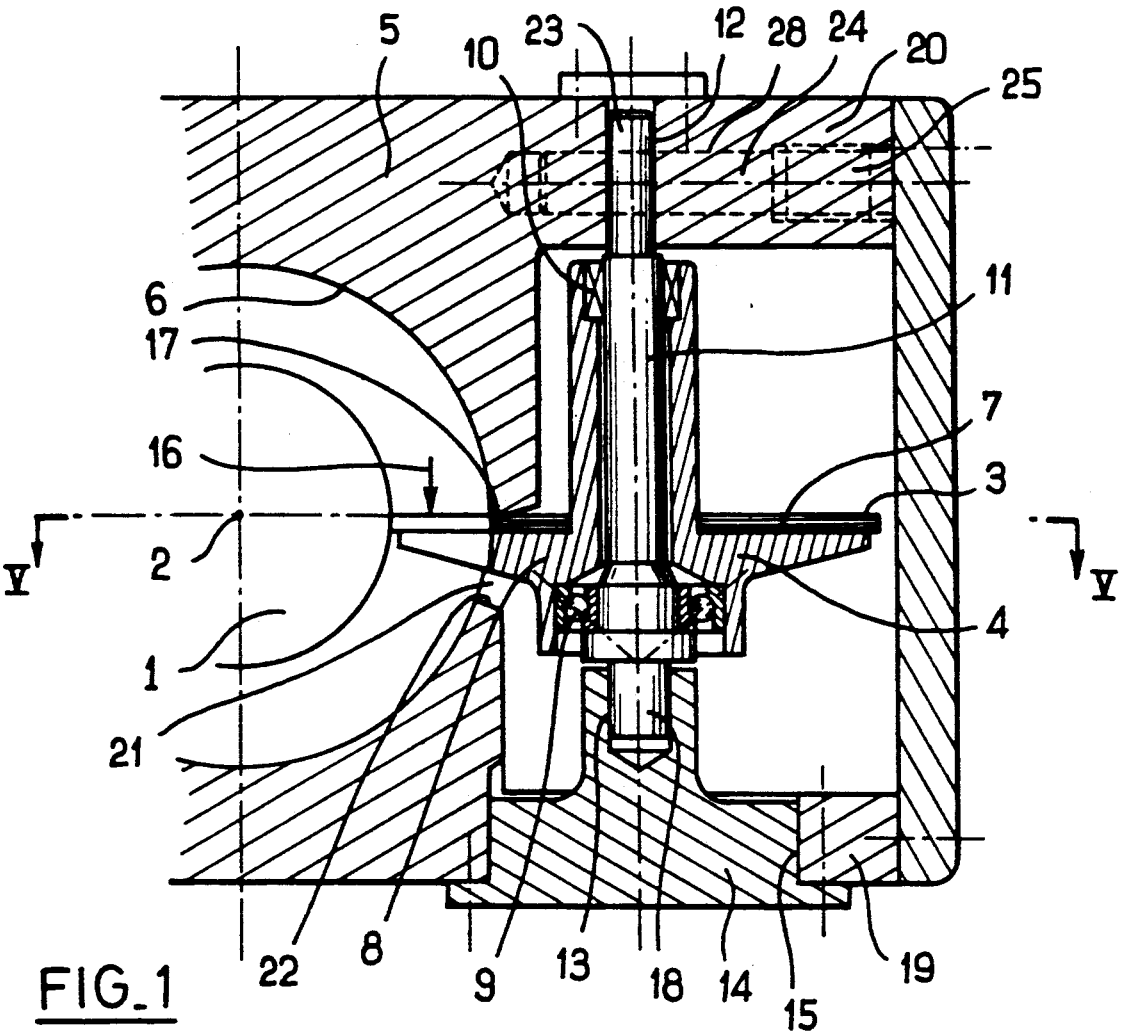
FIG. 1 is a sectional part-view, along line I—I of FIG. 5, of a machine according to the invention along the axis of a gaterotor thereof perpendicular to the screw axis.
Figure 5:
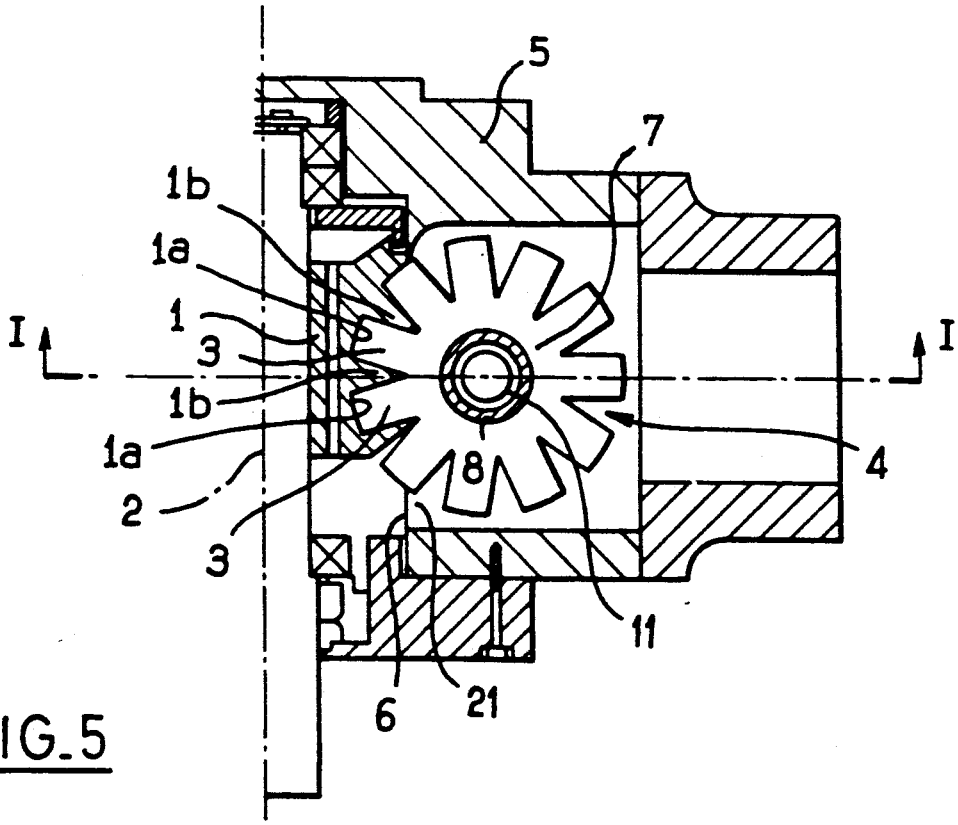
FIG. 5 is a diagramatic sectional half-view of the machine along line V—V of FIG. 1.

The machine shown in FIGS. 1 and 5 is a modification according to the invention of a machine such as shown for instance in U.S. Pat. No. 3,180,565.

A screw 1 rotatable around an axis 2 is provided with generally helical screw grooves 1*a* (FIG. 5) which mesh with teeth such as 3 of a gaterotor 4. Both are mounted in a casing 5 having a bore 6 which is in sealing proximity with the top of screw threads 1*b* separating the screw grooves 1*a* from each other. Due to meshing between the screw 1 and the gaterotor 4, rotation of the screw 1 entails corresponding rotation of the gaterotor.

The gaterotor is made in a known way of a plastic sheet 7 supported by a metal support 8, such metal support carrying itself two bearings 9 and 10 rotatably supporting the gaterotor 4 onto a fixed shaft 11.

This shaft 11 has its axis set by a bore 12 in the casing and a bore 13 in a holder 14 which is itself centered in a bore 15 of the casing.

In such a structure the fluid to be compressed or expanded has its high pressure acting according to the direction of arrow 16 thereby pushing the gaterotor to rest on bearing 9 which is for instance an angular ball bearing and has therefore an axial load capability.

An important factor in the efficiency of the machine is the clearance existing in operation between the face of plastic gaterotor 7 exposed to pressure following arrow 16 and a lip 17 formed in the casing adjacent the bore 6 along a corresponding side of a slot 21 through which the teeth 3 successively protrude in the bore 6 to mesh with the screw grooves.

According to the prior art, the end 18 of the shaft 11 is attached to the holder 14 (or pressed against the bottom of the hole 13), whereby the axial location of the gaterotor is defined by the position of the holder 14, for instance by a shim of adequate thickness disposed between this holder and the casing.

In such a known embodiment as well as in the other known embodiments where the shaft is integral with the gaterotor and rotates in bearings mounted respectively in the holder 14 and the opposite side of the casing, the anchoring point, defining the axial position of the gaterotor, is in the portion 19 of the casing on the low pressure side of the gaterotor and not in the portion 20 of the casing on the high pressure side of the gaterotor.

The slot 21 provided between the lip 17 and an opposite face 22 of slot 21 allows the portion 19 of the casing, because of pressure, heating or cooling distortion, to move slightly with respect to the lip 17, thereby moving at the same time the gaterotor. This can create a gap and consequential leaks between the lip 17 and the gate rotor, said leaks being deterimental to efficiency of the machine, or create between the lip 17 and the gaterotor a mechanical interference which can damage the gaterotor and even destroy it.

By contrast with all this, the invention provides anchoring of the gaterotor shaft by its end 23 in bore 12. More specifically, said anchoring uses a key 24 pushed by a screw 25 in a bore 28.

Figure 2:
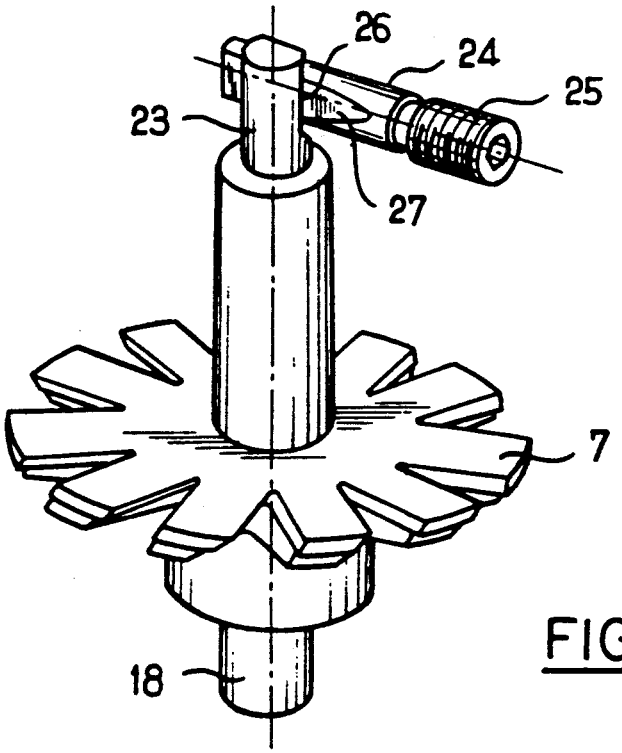
FIG. 2 is a perspective view of the gaterotor, its shaft and key according to the invention.
Figure 3:
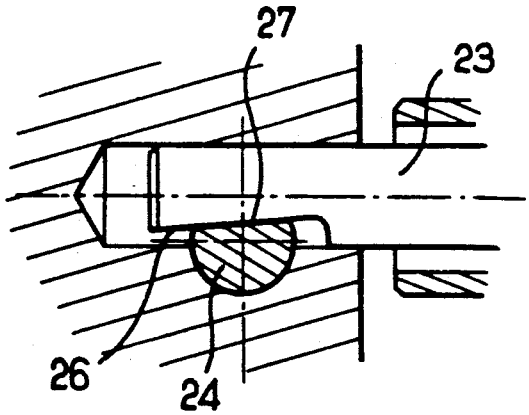
FIG. 3 is a sectional view of the end of the gaterotor shaft of FIG. 2, along the shaft axis.
Figure 4:
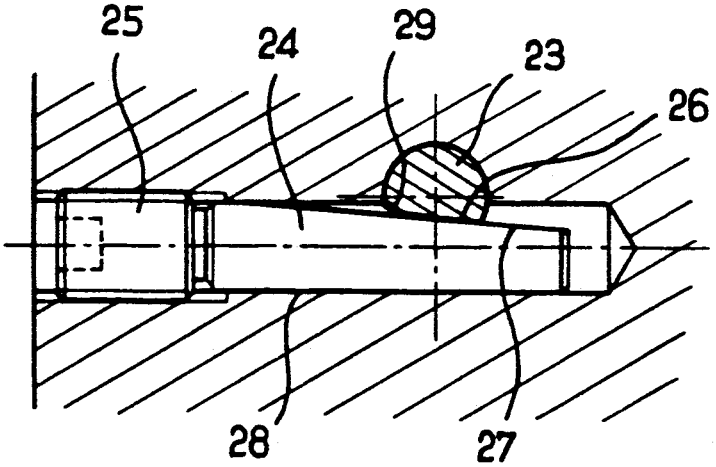
FIG. 4 is a sectional view of the end of the gaterotor shaft of FIG. 2, along the key axis.

As shown in FIGS. 2, 3 and 4, the end 23 of the shaft 11 is provided with a flat portion 26 which is engageable by a flat portion 27 provided on the key 24. The flat portions 26 and 27 are adapted to lie flat against eachother.

The flat portion 26 can be parallel to the axis of the gaterotor or, preferably, slopes as seen in FIG. 3 i.e. with the thickness of the shaft left by this portion increasing from the gate rotor towards the end face of end 23.

The angle between the flat portion 26 and the axis of the shaft 11 can be equal to e.g. 5° . This angle should not reach or exceed the values of reversibility (around 10° ), i.e. the angle values for which pushing of the key 24 by the screw **2*b* would entail a corresponding axial displacement or urging of shaft 11** along its axis.

At the time of assembly of the gaterotor in the casing, the gaterotor is pressed gently against the casing lip 17, the key 24 is introduced in the bore 28 and the flat portion 27 comes into contact with the flat portion 26 and the key is then tightened by screw 25.

A small bevel 29 is provided along the front edge of the flat portion 26 of the shaft in order to prevent said edge to print into the key. This could lead to a bad match of both flat surfaces 26 and 27.

The motion of the key 24 is perpendicular to the axis of shaft end 23. Thus, locking of the key does not affect the axial position of the shaft 11 by contrast with more conventional systems such as nuts and screws made on the shaft itself. The slope of shaft portion 26 being smaller than reversibility, the effort created by the key cannot result in a force pulling or pushing the gaterotor axially.

Such a slope is not absolutely necessary, the flat portion 26 could be parallel to the gaterotor axis. However, thanks to the slope, when the gaterotor is running and is subjected to the load represented by arrow 16, the shaft 11 cannot slide whatever the vibrations, load and time elapsed.

It is therefore possible, by a very simple and compact mechanism to position the plastic gaterotor 7 in a very accurate position with regard to lip 17.

The mechanism is so accurate that even though the gaterotor is gently pressed against the lip, it has been found that after running hundreds of hours, the face of the plastic gaterotor supposed to be in frictional contact against the lip 17 proved to be free of wear.

It seems that the load which exists as soon as the machine is running is providing, through elongation of shaft 11 and compression of the balls of bearing 9, a small clearance between the lip 17 and the plastic.

In fact, as a result of delicate measurements made on a compressor having screw and gaterotor diameters equal to 140 millimeters, operating with refrigerant called "R 22" under a high pressure between 1500 and 2500 kilopascal and a low pressure around 600 kilopascal, the gaterotor appears to move axially by around 20 microns.

It is remarkable to note that with gaterotors conventionally anchored in the low pressure part 19 of the casing, axial displacements of 50 to 80 microns have been recorded under similar conditions.

This new anchoring mechanism has therefore a noticeable effect on the volumetric and isentropic efficiency.

It has also the further advantage to make the assembly of the gaterotor very fast, simple and reliable by eliminating any shim or adjustment by systems like bolts and nuts.

It should be noted that the invention has been presented with the gaterotor being pressed gently against the lip but according to the case, it can be pressed with a given load or on the contrary pressed against a shim set between the gaterotor and the lip, just for the purpose of assembly (if for instance the gaterotor is liable to run without any load at certain moments and could rub against the lip).

It would not change the invention if the ball bearing 9 and needle bearing 10 were replaced by plain bearings, for instance water lubricated carbon bearings, or if the key instead of being pushed would be installed on the opposite direction and pulled; or if the gaterotor shown with a flat surface had a conical one; or if the screw presented as having an outer cylindrical shape had other shapes such as conical or flat.

It would not change the invention if the key surface contacting the shaft surface would not be flat but have other shapes such as conical or cylindrical.

What is claimed:

1. A positive displacement rotary machine to compress or expand a fluid between a high and a low pressure, comprising a screw provided with at least one groove, rotatably mounted in a casing and meshingly cooperating with at least one gaterotor rotatable about a gaterotor axis and carrying teeth which protrude into the groove to define with the casing a volume for variation of pressure of the fluid, one side of the teeth having a substantial radial component of direction in relation to said gaterotor axis and being exposed to the high pressure fluid, the high pressure side of the teeth being in sealing proximity with a lip of the casing, shaft means supporting said gaterotor on said gaterotor axis, and attachment means for securing axial position of said shaft means to the casing and maintaining the sealing proximity of the high pressure side of said teeth with said lip said attachment means being located in a portion of said casing facing the high pressure side of the teeth, thereby to maintain the sealing proximity of the high pressure side of said teeth with said lip by tensile loading of the shaft.

2. A positive displacement rotary machine to compress or expand a fluid between a high and a low pressure, comprising a screw provided with at least one groove, rotatably mounted in a casing and meshingly cooperating with at least one gaterotor rotatable about a gaterotor axis and carrying teeth which protrude into the groove to define with the casing a volume for variation of pressure of the fluid, one side of the teeth having a substantial radial component of direction in relation to said gaterotor axis and being exposed to the high pressure fluid, the high pressure side of the teeth being in sealing proximity with a lip of the casing, wherein the center of the gaterotor is hollow and carries bearings supporting the gaterotor for rotation around a fixed shaft extending through the gaterotor and wherein said shaft is secured to the casing in a portion thereof facing the high pressure side of the teeth by attachment means.

3. A positive displacement rotary machine to compress or expand a fluid between a high and a low pressure, comprising a screw provided with at least one groove, rotatably mounted in a casing and meshingly cooperating with at least one gaterotor carrying teeth which protrude into the groove to define with the casing a volume for variation of pressure of the fluid, one side of the teeth being exposed to the high pressure fluid, the high pressure side of the teeth being in sealing proximity with a lip of the casing, wherein the center of the gaterotor is hollow and carries bearings supporting the gaterotor for rotation around a fixed shaft extending through the gaterotor and wherein said shaft is secured to the casing in a portion thereof facing the high pressure side of the teeth by attachment means comprising a key, which has an axis substantially perpendicular to the shaft axis and is pressed against a flat portion provided on said fixed shaft.

4. A positive displacement rotary machine as claimed in claim 3, wherein the flat portion made on the fixed shaft has with respect to the shaft axis a small slope such that the thickness of the shaft left by such portion increases along an axial direction pointing away from the gaterotor teeth.

* * * * *